United States Patent [19]

Zeuner et al.

[11] 4,050,596

[45] Sept. 27, 1977

[54] ELECTROHYDRAULIC VALVE ASSEMBLY FOR FRONT END LOADER ATTACHMENT TO FARM TRACTOR

[75] Inventors: Kenneth W. Zeuner, Newtown; Alonzo B. Jarman, Wrightstown, both of Pa.

[73] Assignee: Control Concepts, Inc., Newtown, Pa.

[21] Appl. No.: 598,726

[22] Filed: July 24, 1975

[51] Int. Cl.[2] ..... E02F 3/74

[52] U.S. Cl. ..... 214/131 A; 60/468; 60/DIG. 2; 214/762

[58] Field of Search ..... 214/131 A, 138 R, 140, 214/762-763, 764, 771; 280/420, 421, 422; 37/DIG. 1; 172/315, 316; 56/15.6; 60/468, 494, DIG. 2

[56] References Cited

U.S. PATENT DOCUMENTS

| | | | |
|---|---|---|---|
| 3,302,317 | 2/1967 | Domres | 172/316 X |
| 3,631,762 | 1/1972 | Fuzzell | 60/DIG. 2 |
| 3,703,931 | 11/1972 | Page et al. | 172/4.5 |
| 3,721,357 | 3/1973 | Williamson | 214/138 R |

OTHER PUBLICATIONS

Triggs Hydraulic Loader, Triggs Manufacturing Co., Belmond Iowa, Nov. 1, 1967.

*Primary Examiner*—L. J. Paperner
*Attorney, Agent, or Firm*—Frailey & Ratner

[57] ABSTRACT

An attachment for converting a farm tractor to a front end loader having front and upwardly extending frame members, a pair of boom arms and an implement. Hydraulic cylinders actuate the boom arms and implement. An electrohydraulic valve assembly is hydraulically coupled to the cylinders and is rigidly secured to the attachment outside of the cab. A switching assembly electrically switches the electrohydraulic valve assembly and is secured within the cab for easy access to the operator of the tractor. An electrical cable is coupled between the switching assembly within the cab and the electrohydraulic valve assembly outside of the cab.

12 Claims, 4 Drawing Figures

FIG. 2
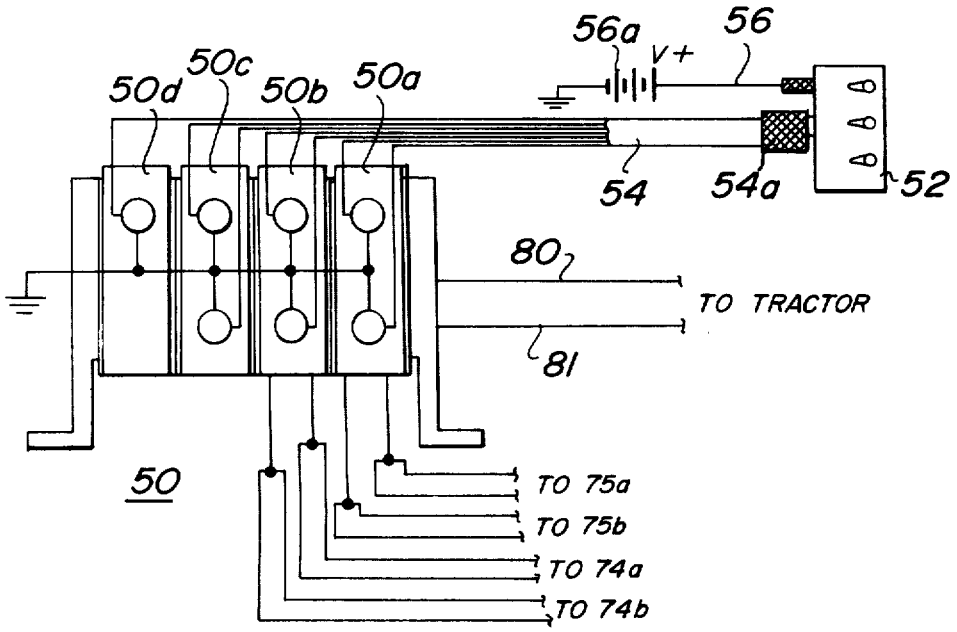
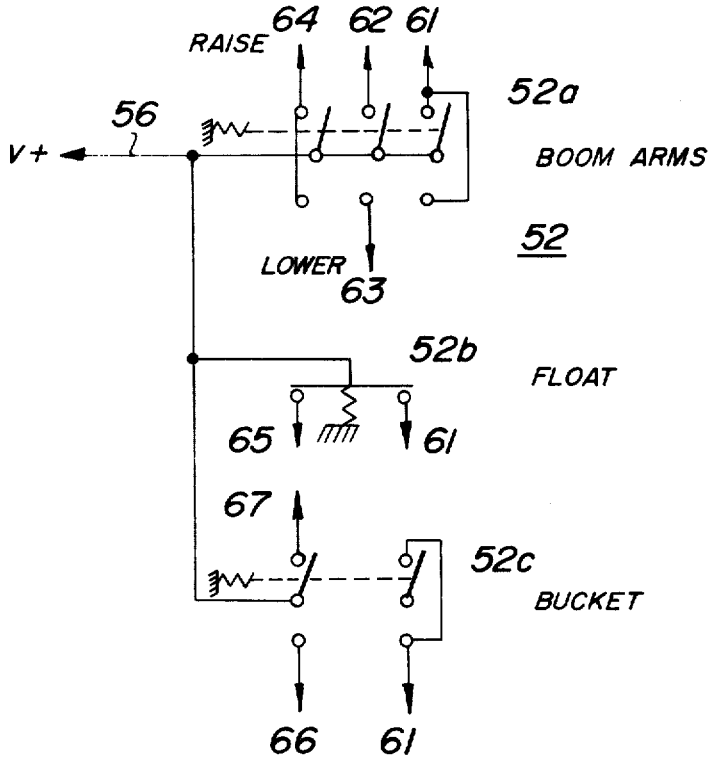
FIG. 3

ELECTROHYDRAULIC VALVE ASSEMBLY FOR FRONT END LOADER ATTACHMENT TO FARM TRACTOR

BACKGROUND OF THE INVENTION

A. Field of the Invention

This invention relates to the field of front end loader conversion kits.

B. Prior Art

Tractors and particularly farm tractors have in the past been converted to front end loaders by means of special front end loader conversion kits normally sold as "after market" add on attachments. Such a conversion kit forms a complete unit which is rigidly secured to the frame and rear axle of the tractor. The kit includes an hydraulic system for operating the tilting bucket with a manual valve and control assembly normally rigidly secured to the frame of the conversion kit. In this way, such a conversion kit is a self-contained unit which is installed by merely bolting it in place to the tractor and coupling the hoses from the valve and control assembly to the hydraulic pump and drain of the tractor.

However, such prior conversion kits have left much to be desired. Specifically, the control handles of the valve and control assembly have been positioned with respect to the frame of the conversion kit since that is where the assembly is secured. Accordingly, the control handles have not usually been convenient for manipulation from the operator's seat of the tractor. This is an important problem since many farm tractors have now fully enclosed cabs to protect the operator from noise, dirt, heat, cold, etc. Accordingly, it has been extremely difficult for the operator to reach around out of a door of an enclosed cab in an attempt to operate the handle. In some cases, the operator has had to open a window of the cab or make special openings in the cab for this purpose. However, all of this defeats the purpose of an enclosed cab to provide the operator with a controlled and protected environment.

In an attempt to overcome these difficulties, it has been known to actually remove the valve and control assembly from the frame of the conversion kit and install the assembly within the cab. However, this leaves much to be desired since such an installation has required the undesirable breaking through of the fire wall. Then, the hydraulic hoses which connect the valve assembly with the cylinders and the pump and drain have been brought into the cab. This almost completely defeats the controlled environment of the cab by bringing in heat from hoses carrying hot oil and hydraulic noise from the hydraulic system. There is also an unacceptable danger to the operator from hot oil leaks in the hoses or assembly. All of the foregoing heat, noise and dangerous conditions may be in violation of proposed OSHA regulations.

SUMMARY OF THE INVENTION

An attachment for converting a farm tractor having a cab to a front end loader which has front and upwardly extending frame members and a pair of boom arms. A pair of hydraulic cylinders is effective for actuating the boom arms and an implement is pivotally connected to the boom arms and is actuated by at least one additional hydraulic cylinder. An electrohydraulic valve assembly is hydraulically coupled to all of the cylinders and is rigidly secured to the attachment outside of the cab. A switching assembly having a plurality of switches is adapted for electrically switching the electrohydraulic valve assembly. The switching assembly is secured within the cab for easy access to the operator of the tractor. An electrical cable is coupled between the switching assembly in the cab and the electrohydraulic valve assembly outside of the cab. It is in this way that there is avoided hydraulical oil lines and valves within the cab.

BRIEF DESCRIPTION OF THE DRAWINGS

FIG. 2 illustrates in more detail the electrohydraulic valve assembly and switching assembly shown in FIG. 1;

FIG. 3 schematically illustrates the individual switches of the switching assembly of FIGS. 1 and 2.

Referring now to FIGS. 1-4, there is shown a front end loader conversion kit 10 for a conventional farm tractor 11. Tractor 11 has a fully enclosed cab 20 or body which provides the operator with protection from noise, dirt, shock, vibration, heat and cold as well as dust, wind and other adverse weather conditions.

Specifically, the windows, doors and body of cab 20 are tightly sealed and the atmosphere of the cab is pressurized and filtered. In this way, dust and powdery snow, for example, are kept from the interior of cab 20. In addition, a heater and an air conditioner allow the operator to adjust temperature and humidity. The further addition of padding and vibration protection all together form a controlled environment in the cab's interior.

Figure 1:
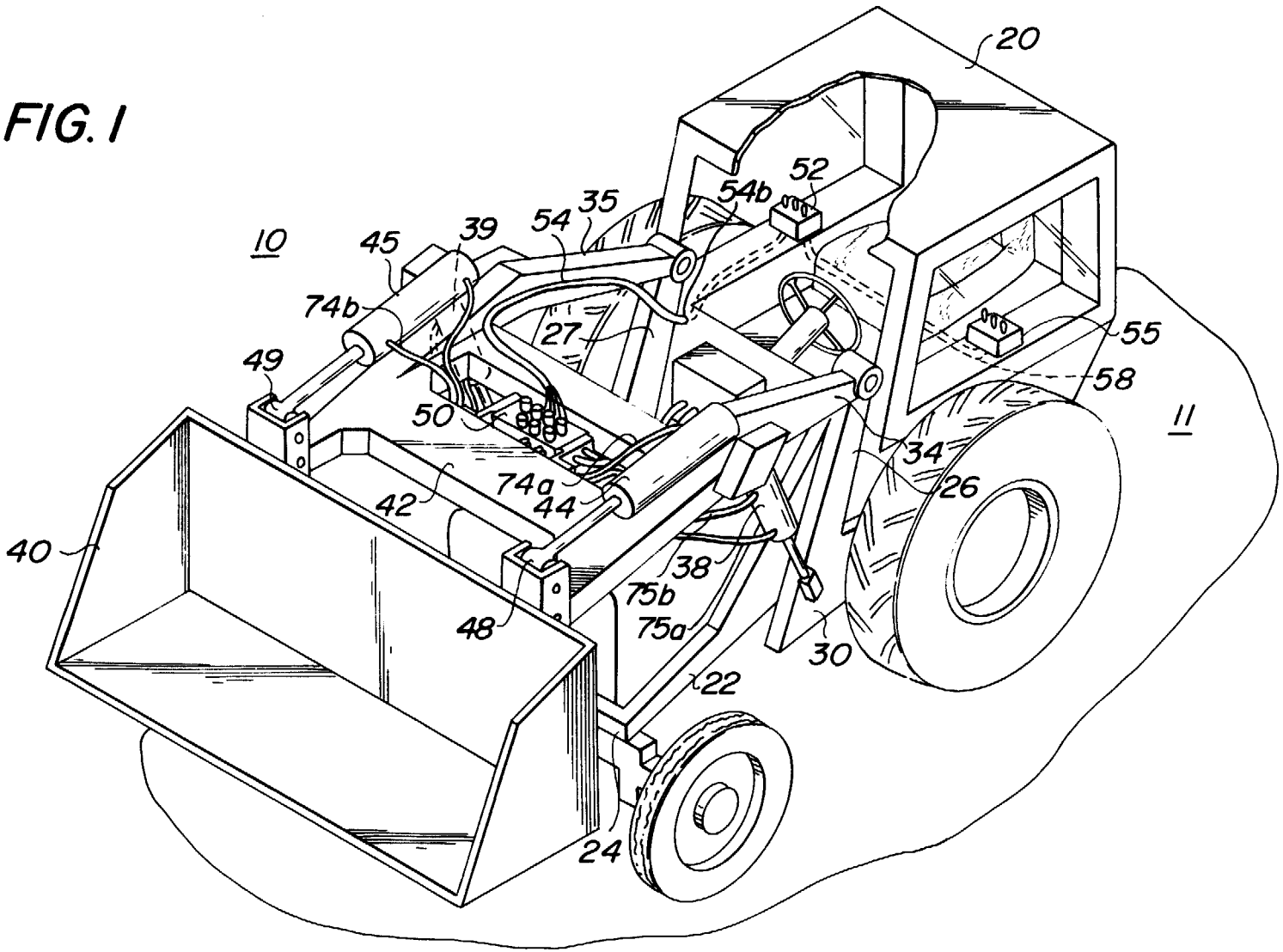
FIG. 1 shows an attachment mounted on a farm tractor converting it to a front end loader embodying the invention.

Conversion kit 10 shown in more detail in FIGS. 1-3 is an add on attachment for tractor 11 and is usually attached in the field. Kit 10 comprises an integral box frame formed of a pair of horizontal frame members 22, 23 rigidly secured together at one end of frame bumper 24. The other ends of frame members 22 are rigidly secured to substantially vertical frame members 26, 27 respectively. The lower ends of frame members 26, 27 are rigidly secured to lower supporting frame members 30, 31 respectively. Members 30, 31 provide support for conversion kit 10 by means of bolting the members to or adjacent to the rear axle housing (not shown) of the tractor. Further support is provided by securing members 22, 23 adjacent from bumper 24 to the frame of tractor 11 as for example by bolts.

A pair of boom arms 34, 35 are coupled for pivotal movement to the upper end of frame members 26, 27. Boom arms 34, 35 are raised and lowered by a pair of parallel double acting hydraulic cylinders 38, 39 pivotally connected between vertical frame members 26, 27 and boom arms 34, 35 respectively. A tilt bucket 40 is coupled for pivotal movement by way of a pair of pivots coupled to the forward ends of boom arms 34, 35. Bucket 40 is actuated between its dump and carry position by a pair of parallel double acting hydraulic cylinders 44, 45 which are pivotally connected between boom arms 34, 35 respectively and pivots 48, 49 of bucket 40.

A structural support member 42 secures together boom arms 34, 35 and provides a seat for the electrohydraulic valve assembly 50 which is controlled by electric switch assembly 52.

It will be understood that valve assembly 50 is coupled by lines and hoses in conventional manner to each of the cylinders 38, 39, 44 and 45. In addition, conventional hoses couple valve assembly 50 to the pump and drain connection of tractor 11. The only device that is not secured to coversion kit 10 is switch assembly 52 which is simply secured inside cab 20 as for example by bolting the assembly within the cab in a position where it would be most comfortable for actuation by the operator. Assembly 52 is grounded to the frame of tractor 10. An electric cable 54 is coupled at one end to valve assembly 50 and is coupled at its other end by way of a plug in connector **54*a* to assembly 52. Cable 54 is passed through cab 20 by way of a small hole such as a 1½ inch diameter drilled through the wall of the cab. A seal 54*b*** is used to plug the gap around the cable after it has been installed in order to maintain the integrity of the cab.

Cable 54 may then be fastened to boom 34 and coupled to valve assembly 50. In addition, a power wire 56 (source of supply V+) coupled to switch assembly 52 is connected in conventional manner to a battery **56*a*** or output of the tractor ignition switch.

It is in this manner that the integrity and the controlled environment of fully enclosed cab 20 may be maintained while still providing for easy and convenient operation of the front end loader 10 within the cab. In this way there is provided electrically remote actuation of the front end loader by means of easily reached electric switches of assembly 52 without the necessity of bringing hydraulic oil and valves within the cab. This is achieved by the use of only three distinct parts, viz, (1) valve assembly 50, (2) cable 54 and (3) switch assembly 52.

There now follows a description of valve assembly 50 under the control of switch assembly 52.

Figure 4:
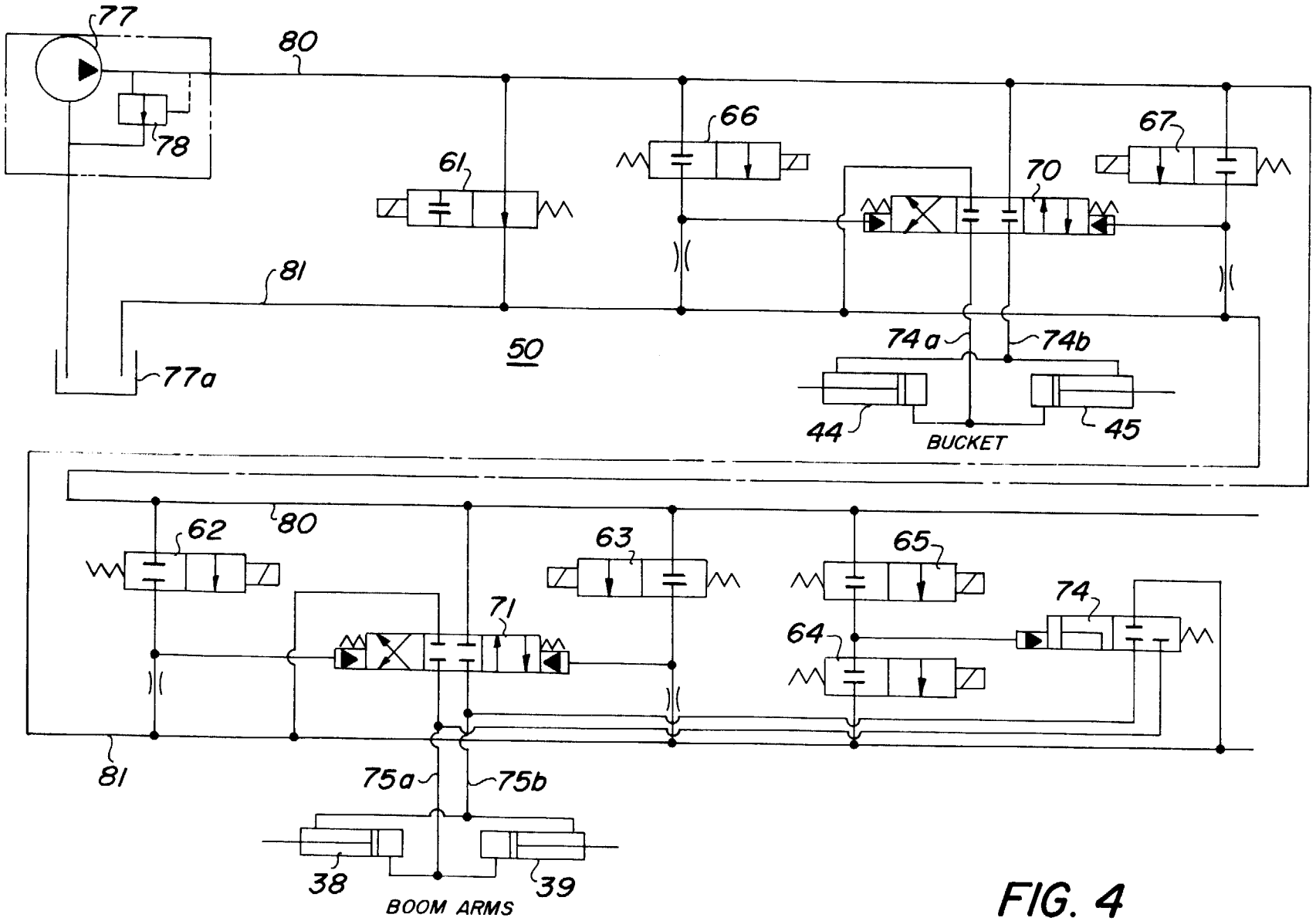
FIG. 4 schematically illustrates the hydraulic circuit of the electrohydraulic valve assembly of FIGS. 1 and 2.

As shown in FIGS. 2 and 4, valve assembly 50 comprises a stacked valve assembly comprising solenoid valves 61–67 and pilot operated four way spool valves 70–72. As shown, valve assembly 50 comprises a group of valve sections **50*a–d* which have been stacked together. Each of the valve sections may comprise one or two solenoid valves and a spool valve. It is in this way that a unitary valve assembly 50 may be easily mounted on conversion kit 10** as previously described. It will be understood that such a unitary assembly may be provided by means other than a stacked valve assembly such as a single casting within which all of the valves are assembled.

As illustrated in valve assembly 50, lines **74*a, b* are taken from spool valve 70 and coupled to cylinders 44, 45. Similarly, lines 75*a, b* are taken from spool valve 71 and coupled to cylinders 38, 39. The hydraulic fluid pump on tractor 11 is indicated as pump 77 which may have a relief valve 78. Pump and drain lines 80, 81 from pump 77 and reservoir 77*a* respectively are applied to valve assembly 50** as indicated.

Solenoid valve 61 is only used if tractor 11 uses an open center system and thus assembly 50 requires a normally open condition as illustrated. In the event that tractor 20 uses a closed center system, valve 61 is made normally closed and inoperable which change may be made in the field. Specifically, valve 61 may be a two stage valve shown in U.S. Pat. No. 3,799,497 in which the first stage has a shoe structure shown in U.S. Pat. No. 3,765,644. Accordingly, a screw adaptor (not shown) may be fitted in the upper section of the sleeve assembly in order to close the plug in the orifice. In this way, the valve would become normally closed and inoperable for a closed center system.

One terminal of the coil of each solenoid valve 61–67 is connected to ground and the other terminal of each valve is selectively connected by way of cable 54 and switch assembly 52 to a source V+ of electrical supply. The specific connections to the coils of valves 61–67 are indicated in FIG. 3. Upon actuation of switches **52*a–c*, source V+ of electrical supply is supplied to selected ones of the valves for actuation thereof. Specifically, switch 52*a* comprises a spring centered triple pole double throw switch and is effective to raise or lower boom arms 34, 35. Single pole single throw float switch effects float and spring centered double pole double throw section 52*c* operates bucket 40**.

In operation, switch **52*a* may be manually pulled upwardly to its raise position and thus potential V+ is connected to the coils of solenoid valves 61, 62 and 64. With its coil energized, valve 61 closes so that pump line 80 is pressurized. Actuated pilot valve 62 opens thereby pressurizing the left side of spool valve 71 thereby applying pressure to the left side of the cylinder. The cylinder of valve 71 is normally sprung to the center position with all ports blocked. Thus, with its left side pressurized, the cylinder moves to the right. Accordingly, pressure is connected to the cross position so that pressure is applied to line 75*a* and tank to line 75*b*. Thus, the illustrated "bottom" sides of cylinders 38, 39 are pressurized and thus boom arms 34, 35** raise.

With regard to the float, it will be seen that pilot valve 64 has also been energized and thus, this valve is open. Accordingly, float spool 72 is depressurized and is in its normally sprung position in which all of its ports are blocked. Thus, float spool 72 has no effect upon lines **75*a, b***.

With switch **52*a* in the raised position, boom arms 34, 35 continue to raise until switch 52*a* is released and returns to its spring center position. Accordingly, the coils of valves 61, 62 and 64 are deenergized and valve 71 returns to its normal position in which all of its ports are blocked thereby maintaining the position of the boom arms. Additionally, float spool valve 72 remains in its blocked position and unload valve 61** opens dumping to tank.

In order to lower boom arms 34, 35, switch **52*a* is pulled to its lower position. In the manner previously described, valve 61 is energized to its closed position and valve 64 is energized and thus, float valve 72 remains in its blocked position. In the lower position, valve 63 is energized and thus, the right side of spool valve 71 is pressurized moving the cylinder to the left. Accordingly, the lines are reversed from that previously described and boom arms 34, 35 lower. The arms lower until switch 52*a*** is released to its center position at which time the boom arms remain in that position.

The float operation can only be effected when switch **52*a* is in its center position. At that time, float switch 52*b* may be actuated to connect supply V+ to the coils of valves 61, 65. Accordingly, the system is pressurized and valve 65 is actuated to its open position thus, pressurizing the pilot of spool valve 72. In this way, the spool valve is actuated so that tank is coupled to both lines 75*a, b* which are connected to both sides of cylinders 38, 39**.

In this manner with float switch **52*a* actuated, boom arms 34, 35 and thus bucket 40** can float up and down (free wheel) as the bucket passes over the terrain.

Switch 52*b* is a momentary closed switch so that when the the switch is released, valve 65 closes thereby locking in the oil to the pilot of spool valve 72. Accordingly, the bucket is allowed to continue to float with switches 52*a, b* in their normally sprung positions and no electrical energy is being used by valve assembly 50. In this way, the front end loader may operate for many hours with bucket 40 floating on the ground with conservation of electrical energy.

Cylinders 44, 45 for bucket 40 are operated by spool valve 70 in conjunction with pilot valves 66, 67 in a manner similar to that previously described with respect to spool valve 71. Specifically, with switch 52*c* pulled to its lower position, valve 61 is energized to its closed position and valve 66 is energized also to its closed position and thus, left side of spool valve 70 is pressurized moving the cylinder to the right. Accordingly, pressure is connected to the cross position so that pressure is applied to line 74*a* and tank to line 74*b.* Thus, the illustrated "bottom" sides of cylinders 44, 45 are pressurized and thus, the bucket lowers. This continues until switch 52*c* is released and returns to its spring center position.

With switch 52*c* pushed to its upper raise position valves 61 and 67 are energized and therefore, the right side of spool valve 70 is pressurized moving the cylinder to the left. Accordingly, the lines are reversed and bucket 40 raises. The bucket raises until switch 52*c* is released to its center position at which time the bucket remains in that position.

It will be understood that further modifications may be made. For example, an additional switch assembly 55 may be provided which is coupled by means of suitable connectors and a cable 58 to switch assembly 52. In this manner, switch assembly 55 may be mounted on the left side of cab 20 for example, while assembly 52 is secured to the right side. Thus, if the operator in actuating the front end loader wishes to view an object being loaded on the left side, for example, he can then look out of the left window of cab 20 and operate left assembly 55. On the other hand, if an object to be loaded is on the right side, he can then look out of the right window and operate right assembly 52.

It will be understood by those skilled in the art that additional switch assembly 55 may include an additional set of switches 52 in the manner shown in FIG. 3 with suitable paralleling and electrical connections and relays so that assemblies 55 and 52 properly interface.

As a further embodiment, switch assembly 52 may contain electronic subassemblies (not shown) for the purposes of achieving automated control of conversion kit 10. For example, desired functions may be programmed to operate in a predetermined sequence. Further, it will be understood that switch assembly 52 may be installed during the manufacture of cab 20 so that it becomes a part of the permanent paneling in cab 20. Thus, cable 54 would, during manufacture of the cab, be passed underneath the chassis and preferably terminate in a quick plugging connector near the conventional pressure-drain connector.

What is claimed is:

1. In an attachment for converting a farm tractor having a cab to a front end loader, front frame members extending to the front of said tractor, upwardly extending frame members rigidly secured to said front frame members and providing a supporting pivotal connection for a pair of boom arms, a pair of hydraulic cylinders for actuating said boom arms, an implement pivotally connected to said boom arms and being actuated by at least one additional hydraulic cylinder, said front and upwardly extending frame members being secured to said tractor, in which the improvement combination comprises an electrohydraulic valve assembly having solenoid operated valves, said valve assembly being hydraulically coupled to said pair of cylinders and said additional cylinder and rigidly secured to said attachment outside of said cab, a switching assembly comprising a plurality of switching devices adapted for electrically switching said solenoid operated valves thereby to control said hydraulic cylinders, said switching assembly secured within said cab for easy access to the operator of said plurality of switching devices, electrical cable means coupled between said switching assembly within said cab and said electrohydraulic valve assembly outside of said cab thereby avoiding hydraulic oil lines and valves within said cab, and means directly electrically connecting only a first and a second of said switching devices respectively to a first and a second pair of said solenoid valves, said valve assembly including an unload valve normally maintained open and hydraulically coupling the pressure and tank of said tractor whereby upon actuation of each switching device one solenoid valve of the respective pair is energized and said unload valve is switched to the valve closed state.

2. The combination of claim 1 in which said electrical cable means comprises an electrical cable having a plurality of wires connected to selected ones of said plurality of switches with said electrical cable extending through an opening in said cab and means for sealing said opening.

3. The combination of claim 1 in which there is provided an additional switching assembly having a plurality of switching devices adapted for electrically switching said electrohydraulic valve assembly, said additional switching assembly being secured within said cab remote from said switching assembly.

4. The combination of claim 3 in which there is provided an additional electrical cable electrically connecting said additional switching assembly and said switching assembly thereby providing for either one of said assemblies to electrically switch said electrohydraulic valve assembly, means securing said switching assembly to one side of said cab and said additional switching assembly to another side of said cab.

5. The combination of claim 1 in which said electrohydraulic valve assembly includes a first and a second nonmodulated valve section respectively comprising a first and a second pair of said solenoid operated valves and a first and a second spool valve, said first and second pairs of solenoid valves being hydraulically coupled respectively to said first and second spool valves for pilot operation thereof, said first spool valve being hydraulically coupled to and for operation of said pair of cylinders and said second spool valve being hydraulically coupled to and for operation of said additional cylinder whereby (1) said pair of cylinders is operated upon energization of one of said first pair of solenoid valves and (2) said additional cylinder is operated upon energization of one of said second pair of solenoid valves.

6. The combination of claim 5 in which there is provided means directly electrically connecting only a first and a second of said switching devices respectively to said first and second pair of solenoid valves for energizing a selected one of a pair of solenoid valves when the associated switching device is actuated thereby to actuate the respective spool valve for operating the associated cylinder.

7. The combination of claim 1 in which said electrohydraulic valve assembly is in the form of a stacked valve assembly with each of the valve sections of the stacked valve assembly comprising a pair of said solenoid operated valves and said spool valve.

8. The combination of claim 7 in which said switching assembly includes connector means secured to said tractor and coupled to said electrical cable to provide for the disconnection of said electrical cable between said attachment and said tractor.

9. The combination of claim 1 in which there is provided means adapted to be coupled to said unload valve for selectively maintaining said unload valve in a valve closed state.

10. The combination of claim 1 in which said unload valve is solenoid operated and there is provided means for additionally directly connecting each of said switching devices to said unload solenoid valve.

11. In an attachment for converting a farm tractor having a cab to a front end loader, front frame members extending to the front of said tractor, upwardly extending frame members rigidly secured to said front frame members and providing a supporting pivotal connection for a pair of boom arms, a pair of hydraulic cylinders for actuating said boom arms, an implement pivotally connected to said boom arms and being actuated by at least one additional hydraulic cylinder, said front and upwardly extending frame members being secured to said tractor, in which the improvement comprises an electrohydraulic valve assembly hydraulically coupled to said pair of cylinders and additional cylinder and rigidly secured to said attachment outside of said cab, a switching assembly comprising a plurality of switches adapted for electrically switching said electrohydraulic valve assembly, said switching assembly secured within said cab for easy access to the operator thereof said plurality of switches, electrical cable means coupled between said switching assembly within said cab and said electrohydraulic valve assembly outside of said cab thereby avoiding hydraulic oil lines and valves within said cab, and said electrohydraulic valve assembly including float means comprising a float valve coupled to said pair of hydraulic cylinders having a normal state in which all of the ports thereof are blocked, a first electrohydraulic valve adapted to be switched by said switching assembly for maintaining said float valve in said ports blocked normal state, and a second electrohydraulic valve adapted to be switched by said switching assembly for actuating said float valve to couple together the lines to said pair of hydraulic cylinders thereby to provide float for said implement.

12. The combination of claim 11 in which said electrohydraulic valve assembly includes a third electrohydraulic valve maintained normally open for coupling the pressure and tank of said tractor and adapted to be switched by said switching assembly to the valve closed state for operation of said hydraulic cylinders.

* * * * *